US009841710B1

(12) United States Patent
Kanai et al.

(10) Patent No.: US 9,841,710 B1
(45) Date of Patent: Dec. 12, 2017

(54) TRANSPORT DEVICE, FIXING DEVICE, AND IMAGE FORMING APPARATUS

(71) Applicant: FUJI XEROX CO., LTD., Tokyo (JP)

(72) Inventors: Kenji Kanai, Kanagawa (JP); Shogo Kamiya, Kanagawa (JP); Keisuke Hidaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/353,371

(22) Filed: Nov. 16, 2016

(30) Foreign Application Priority Data

Jun. 8, 2016 (JP) ..... 2016-114531

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/322
See application file for complete search history.

(56) References Cited

U.S. PATENT DOCUMENTS

2012/0180955 A1* 7/2012 Adami ..... B31F 1/2831 156/358

FOREIGN PATENT DOCUMENTS

JP 2012-123389 A 6/2012

* cited by examiner

*Primary Examiner* — Susan Lee
(74) *Attorney, Agent, or Firm* — Sughrue Mion, PLLC

(57) ABSTRACT

A transport device includes: a first rotational member; a second rotational member that forms a nip with the first rotational member; a guide member that guides the medium in a predetermined direction; a changing part that supports the second rotational member so as to be rotatable and that moves the second rotational member to change a nip state between the second rotational member and the first rotational member; and an interposed member supported by the changing part and nipped between the first rotational member and the guide member, the interposed member including, in an intersecting direction intersecting a direction in which the interposed member is nipped, multiple portions having different thicknesses, the interposed member being nipped at any one of the multiple portions, while being moved in the intersecting direction in accordance with the movement of the second rotational member.

3 Claims, 12 Drawing Sheets

TRANSPORT DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2016-114531 filed Jun. 8, 2016.

BACKGROUND

Technical Field

The present invention relates to transport devices, fixing devices, and image forming apparatuses.

SUMMARY

According to an aspect of the invention, there is provided a transport device including: a first rotational member; a second rotational member that forms a nip with the first rotational member and transports a medium by nipping the medium therebetween; a guide member that is disposed so as to leave a gap with respect to the first rotational member and that comes into contact with the medium having passed through the nip to guide the medium in a predetermined direction; a changing part that supports the second rotational member so as to be rotatable and that moves the second rotational member to change a nip state between the second rotational member and the first rotational member; and an interposed member supported by the changing part and nipped between the first rotational member and the guide member, the interposed member including, in an intersecting direction intersecting a direction in which the interposed member is nipped, multiple portions having different thicknesses, the interposed member being nipped at any one of the multiple portions, while being moved in the intersecting direction in accordance with the movement of the second rotational member.

BRIEF DESCRIPTION OF THE DRAWINGS

Exemplary embodiments of the present invention will be described in detail based on the following figures, wherein.

DETAILED DESCRIPTION

Outline

Two exemplary embodiments, namely, a first exemplary embodiment and a second exemplary embodiment, will be described below.

First Exemplary Embodiment

The first exemplary embodiment will be described. First, the overall configuration of an image forming apparatus according to this exemplary embodiment and an image forming operation will be described. Then, the configuration of a fixing device, serving as a relevant part in this exemplary embodiment, and a fixing operation will be described. Finally, advantages of this exemplary embodiment will be described.

Overall Configuration of Image Forming Apparatus

Figure 1:
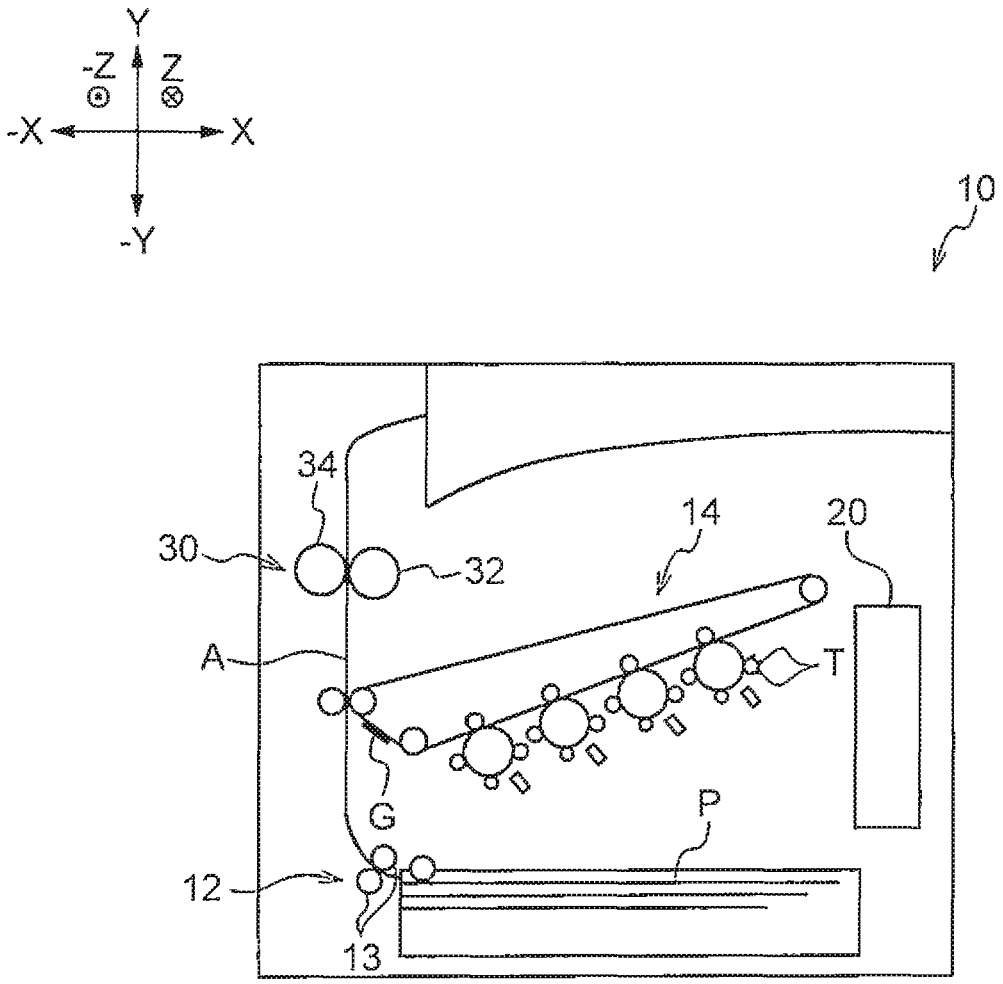
FIG. 1 is a front view showing the configuration of an image forming apparatus according to a first exemplary embodiment.

As shown in FIG. 1, an image forming apparatus 10 according to this exemplary embodiment includes: a transport section 12, which includes a roller pair 13 for transporting a sheet P; an image forming section 14, which form, with toner T, a toner image G on the sheet P transported by the transport section 12; a fixing device 30, which heats the toner image G to fix the toner image G to the sheet P; and a controller 20. The image forming section 14 is an example of a forming section. The sheet P is an example of a medium. The fixing device 30 is an example of a transport device.

The image forming section 14 performs steps including charging, exposure, development, and transfer, which are the steps performed in a known electrophotographic system. The controller 20 controls the respective sections of the image forming apparatus 10, except for the controller 20 itself.

In the description below, a direction indicated by arrows Y and −Y in FIG. 1 is referred to as a height direction of the image forming apparatus 10, a direction indicated by arrows X and −X is referred to as a width direction of the image forming apparatus 10, and a direction perpendicular to the height and width directions of the image forming apparatus 10 is referred to as a depth direction (denoted by Z) of the image forming apparatus 10. In a front view of the image forming apparatus 10, the height, width, and depth directions of the image forming apparatus 10 are referred to as Y, X and Z directions, respectively. When one side and the other side of the X, Y, and Z directions need to be distinguished from each other, in a front view of the image forming apparatus 10, an upper side is referred to as a Y-direction side, a lower side is referred to as a −Y-direction side, a right side is referred to as an X-direction side, a left side is referred to as a −X-direction side, a far side is referred to as a Z-direction side, and a near side is referred to as a −Z-direction side.

Thus, the description of the overall configuration of the image forming apparatus 10 according to this exemplary embodiment has been completed.

Image Forming Operation

Next, an image forming operation according to this exemplary embodiment will be described with reference to FIG. 1.

When the controller 20 receives image data from an external device (not shown), the controller 20 actuates the respective sections of the image forming apparatus 10, except for the controller 20 itself. More specifically, the controller 20 causes the transport section 12 to transport a sheet P, causes the image forming section 14 to form a toner image G, and causes the fixing device 30 to fix the toner image G to the sheet P. The sheet P to which the toner image G has been fixed is discharged outside the image forming apparatus 10. Thus, an image forming operation is completed.

Thus, the description of the image forming operation according to this exemplary embodiment has been completed.

Configuration of Relevant Part

Next, the configuration of the relevant part (the fixing device 30) according to this exemplary embodiment will be described.

Figure 2:
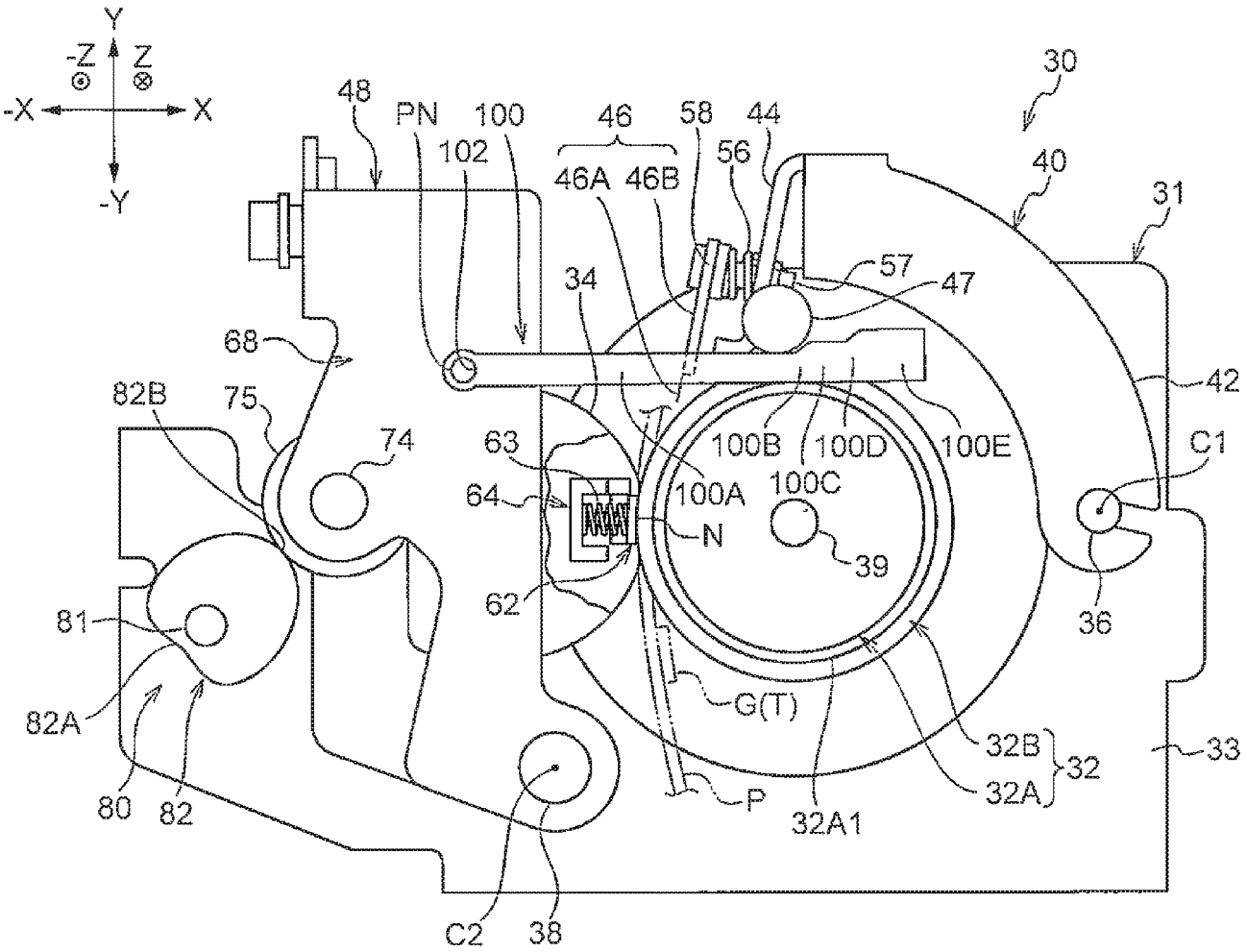
FIG. 2 is a front view of a fixing device constituting the image forming apparatus according to the first exemplary embodiment, showing the case where the pressure state of the nip is a full-latch state.

As shown in FIG. 2, the fixing device 30 according to this exemplary embodiment includes: a housing 31, serving as a principal unit of the fixing device; a fixing roller 32; a pressure belt 34; a separating member 40; a pressure member 48; and interposed members 100. The fixing roller 32 is an example of a first rotational member and a heating part. The pressure belt 34 is an example of a second rotational member and a pressure part. The separating member 40 is an example of a guide member. The pressure member 48 is an example of a changing part.

Housing

As shown in FIG. 2, the housing 31 is formed in a box shape having a longitudinal direction extending in the Z direction and is provided with openings, through which a sheet P can pass, in walls (not shown) on the Y- and −Y-direction sides. The housing 31 also has a pair of side walls 33 facing each other in the Z direction. The side walls 33 are disposed parallel to an X-Y plane. A cylindrical shaft 36 extending in the Z direction is provided on the X-direction side of the side walls 33, and a cylindrical shaft 38 extending in the Z direction is provided on the −X-direction side of the side walls 33.

The shaft 36 projects from the inside to the outside (i.e., toward the Z- and −Z-direction sides) of the side walls 33. The shaft 36 is disposed on the radially outside (i.e., on the X-direction side) of the fixing roller 32 (described below), so as to extend in the axial direction of the fixing roller 32 (Z direction). In FIG. 2, the axis of the shaft 36 is denoted by reference sign C1.

The shaft 38 projects from the inside to the outside (i.e., toward the Z- and −Z-direction sides) of the side walls 33. The shaft 38 is disposed on the outside (i.e., on the −X-direction side) of the pressure belt 34, so as to extend in the axial direction of the pressure belt 34 (Z direction). In FIG. 2, the axis of the shaft 38 is denoted by reference sign C2.

Fixing Roller

As shown in FIG. 2, the fixing roller 32 is formed of a cylindrical core 32A and a rubber layer 32B formed on an outer circumferential surface 32A1 thereof. Although illustration is omitted, the rubber layer 32B is cylindrical and covers the outer circumferential surface 32A1 of the core 32A in such a state that end portions of the core 32A project from ends of the rubber layer 32B. The fixing roller 32 is disposed on a toner image G side (i.e., X-direction side) of a sheet transport path A (see FIG. 1), so as to be rotatable about a shaft extending in the Z direction. A halogen heater 39 is provided inside the core 32A1. The halogen heater 39 is an example of a heat source.

The halogen heater 39 generates heat by receiving power from a power supply (not shown) to heat the core 32A and, thus, the rubber layer 32B. A gear (not shown) is provided on the Z-direction side of the core 32A. The gear is rotated by a motor (not shown). In this manner, the fixing roller 32 is heated by the halogen heater 39 and, in turn, heats a sheet P and a toner image G (toner T) formed thereon while rotating, thus fixing the toner image G to the sheet P.

Pressure Belt

As shown in FIG. 2, the pressure belt 34 is disposed on the other side (−X-direction side) of the sheet transport path A (see FIG. 1) from the fixing roller 32, so as to be rotatable (revolve) about a shaft extending in the Z direction. The pressure belt 34 is an endless belt.

A pressure pad 62 (described below) is provided inside the pressure belt 34. The pressure belt 34, due to the friction between the pressure belt 34 and the fixing roller 32, follows the rotation of the fixing roller 32 and revolves. The pressure belt 34 forms a nip N with the fixing roller 32 and transports the sheet P while nipping the sheet P at the nip N. In this exemplary embodiment, for example, the sheet is transported in the Y direction in the fixing device 30, and the width direction perpendicular to the sheet-transport direction is the Z direction.

Separating Member

The separating member 40 is disposed at a distance (gap G) from the fixing roller 32. The separating member 40 comes into contact with the sheet P that has passed through the nip N to guide the sheet P in a predetermined direction. Herein, the predetermined direction is a direction in which the sheet transport path A (see FIG. 1) extends. As viewed in the Z direction, the transport path A is located on the −X-direction side of a separating baffle 46 (described below). The gap G will be described below.

The separating member 40 includes: a pair of brackets 42 facing each other in the Z direction; an attaching member 44 with the Z-direction ends supported by the brackets 42; the separating baffle 46 attached to the attaching member 44; and securing members 47 fixed to the attaching member 44 (see FIG. 2). Because the bracket 42 on the Z-direction side and the bracket 42 on the −Z-direction side have the same configuration and are disposed symmetrically with respect to the middle part, in the Z direction, of the fixing roller 32, the bracket 42 on the −Z-direction side will be described herein, and the description of the bracket 42 on the Z-direction side will be omitted.

Bracket

As shown in FIG. 2, as viewed in the Z direction, the bracket 42 is formed in an arch shape and is disposed parallel to the X-Y plane. More specifically, the bracket 42 is formed in a quarter-circle shape, which is obtained by dividing a ring-shaped plate into four segments in the circumferential direction. One end (the −Y-direction end) of the bracket 42 in the circumferential direction is rotatably joined to the shaft 36. In other words, the bracket 42 is movable about the shaft 36 (axis C1) in an arch shape around an axis C1, on the radially outer side of the fixing roller 32.

As viewed in the Z direction, the bracket 42 is constantly urged in a counterclockwise direction about the axis C1 by a spring (not shown).

Attaching Member

The attaching member 44 is an elongated member having a longitudinal direction extending in the Z direction (see FIG. 2). As viewed in the Z direction, the Z-direction ends of the attaching member 44 are fixed to the other end of the bracket 42 in the circumferential direction. As viewed in the Z direction, a portion of the attaching member 44 is disposed so as to be inclined with respect to the Y direction, such that the Y-direction end is located on a further X-direction side than the −Y-direction end. The −Y-direction end of the attaching member 44 is bent toward the −X-direction side.

The attaching member 44 has female screw portions (not shown) provided at a distance from each other in the Z direction. These female screw portions receive screws 57. The screws 57 are used to attach a proximal end portion 46A of the separating baffle 46 (described below, and see FIGS. 4A and 4B) to the attaching member 44. Compression coil springs 56 are fitted onto the screws 57. As a result of male threads on the screws 57 being screwed into the female screw portions in the attaching member 44, the compression coil springs 56 urge the proximal end portion 46A of the separating baffle 46 away from the attaching member 44.

Separating Baffle

Figure 4A:
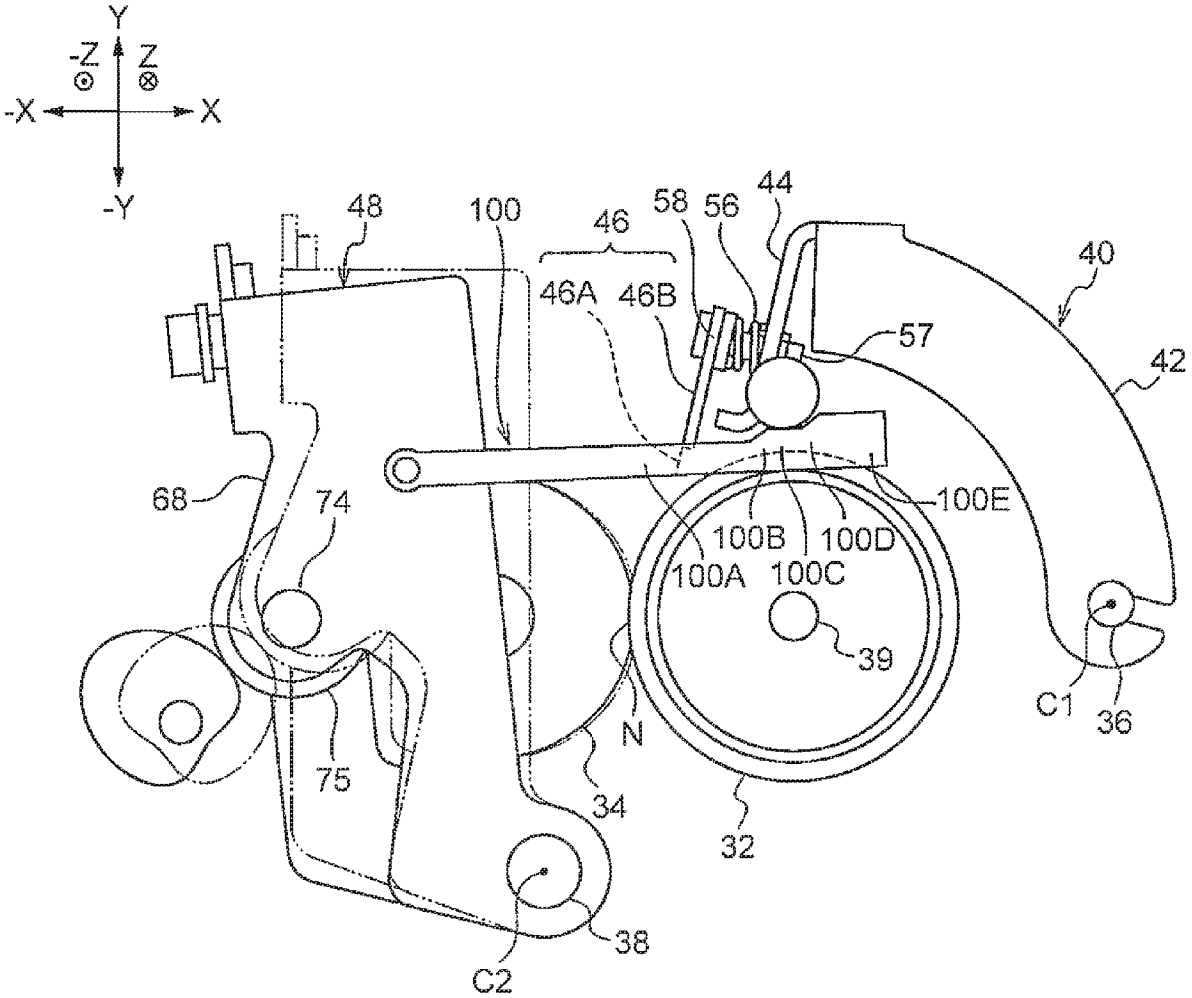
FIG. 4A is a front view of the fixing device according to the first exemplary embodiment, showing the case where the pressure state of the nip is a half-latch state.
Figure 4B:
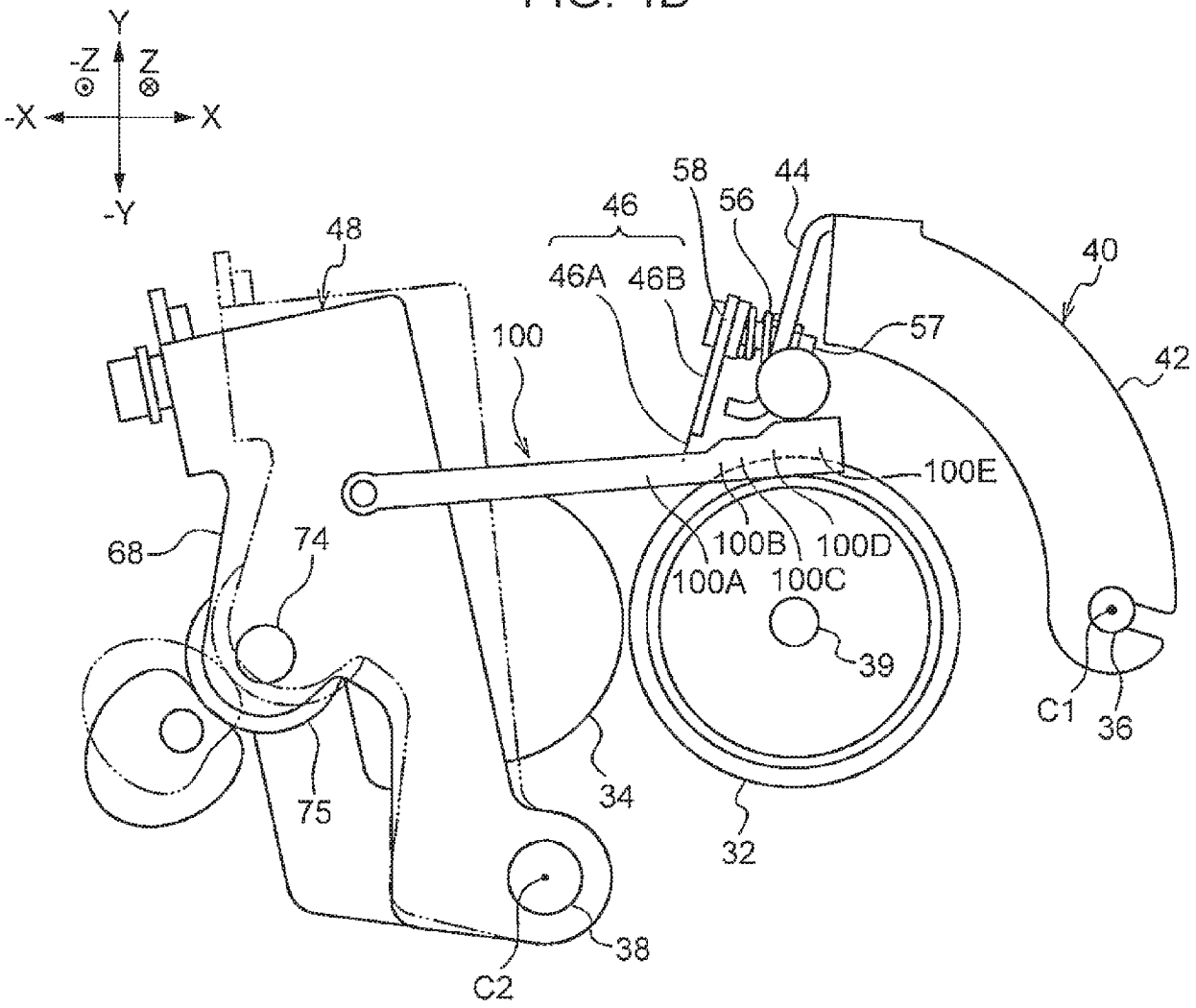
FIG. 4B is a front view of the fixing device according to the first exemplary embodiment, showing an unlatched state in which the nip is not formed.

The separating baffle 46 is formed of a rectangular plate having a longitudinal direction extending in the Z direction (see FIGS. 2, 4A, and 4B). The separating baffle 46 has the proximal end portion 46A and a distal end portion 46B. The proximal end portion 46A is fixed to (held by) a rectangular-plate-shaped holder 58 having a longitudinal direction extending in the Z direction. The holder 58 is attached to a −X-direction side of the attaching member 44 with the screws 57 and is urged toward the −X-direction side by the compression coil springs 56. In this manner, as a result of the proximal end portion 46A being fixed to the bracket 42 via the holder 58, the separating baffle 46 is attached to the bracket 42.

Figure 6:
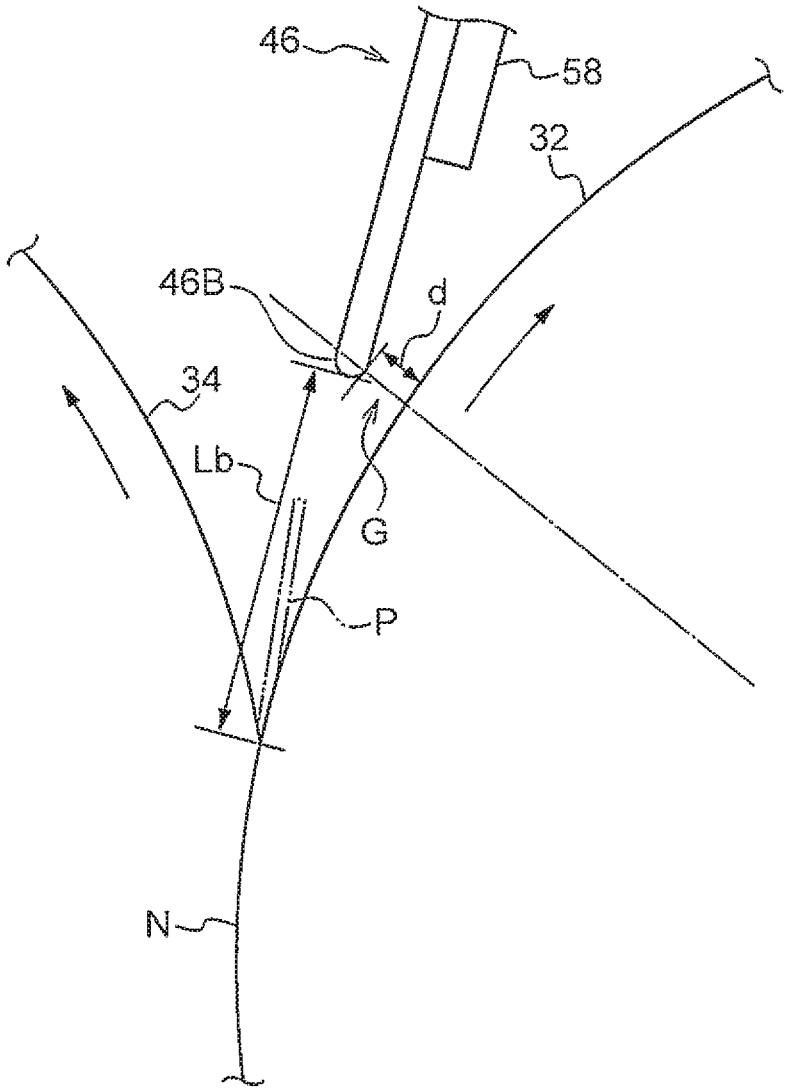
FIG. 6 shows the position of a separating baffle constituting the fixing device according to the first exemplary embodiment.

As shown in FIG. 6, the distal end portion 46B of the separating baffle 46 is a free end projecting from the holder 58. The distal end portion 46B is disposed downstream of the nip N in the sheet-transport direction, at a position a distance d away from the outer circumferential surface of the fixing roller 32 (i.e., the outer circumferential surface of the rubber layer 32B). The transported sheet P comes into contact with the distal end portion 46B. The gap G described above is a gap between the distal end portion 46B and the outer circumferential surface of the fixing roller 32. The width of the gap G between the distal end portion 46B and the outer circumferential surface of the fixing roller 32 is the distance d. The distal end portion 46B is disposed so as to project from the holder 58 in a direction opposite to the rotation direction of the fixing roller 32. Herein, the distance between the downstream end of the nip N and the distal end portion 46B in the sheet-transport direction is referred to as a distance Lb. When the leading end of the transported sheet P in the transport direction comes into contact with the distal end portion 46B of the separating baffle 46, the separating baffle 46 guides (separates) the sheet P in a direction away from the outer circumferential surface of the fixing roller 32.

Securing Member

The securing members 47 are a pair of cylindrical columns that are fixed to the end portions of the attaching member 44 in the longitudinal direction with screws (not shown) (see FIG. 2). The securing members 47 are formed of, for example, metal. The securing members 47 extend in the longitudinal direction of the attaching member 44 and symmetrically project from the ends of the attaching member 44 in the Z and −Z directions. Furthermore, as viewed in the Y direction, the securing members 47 overlap the core 32A projecting from the ends of the rubber layer 32B of the fixing roller 32. The securing members 47 nip the interposed members 100 with the core 32A of the fixing roller 32. As has been described above, as a result of the securing members 47 and the core 32A of the fixing roller 32 nipping the interposed members 100 therebetween, in other words, as a result of the securing members 47 being in contact with the interposed members 100, the brackets 42 (separating member 40) constantly urged by the spring (not shown) are positioned. As a result, the distance d between the distal end portion 46B of the separating baffle 46 and the outer circumferential surface of the fixing roller 32 is determined.

Pressure Member

The pressure member 48 supports the pressure belt 34 so as to be rotatable and moves the pressure belt 34 toward the fixing roller 32 side to change the nip state between the pressure belt 34 and the fixing roller 32. Herein, "to change the nip state" is to switch between two nip states, namely, a state in which the nip N is formed and a state in which the nip N is not formed, and is to change the level of the pressure at the nip N in the state in which the nip N is formed.

Figure 3:
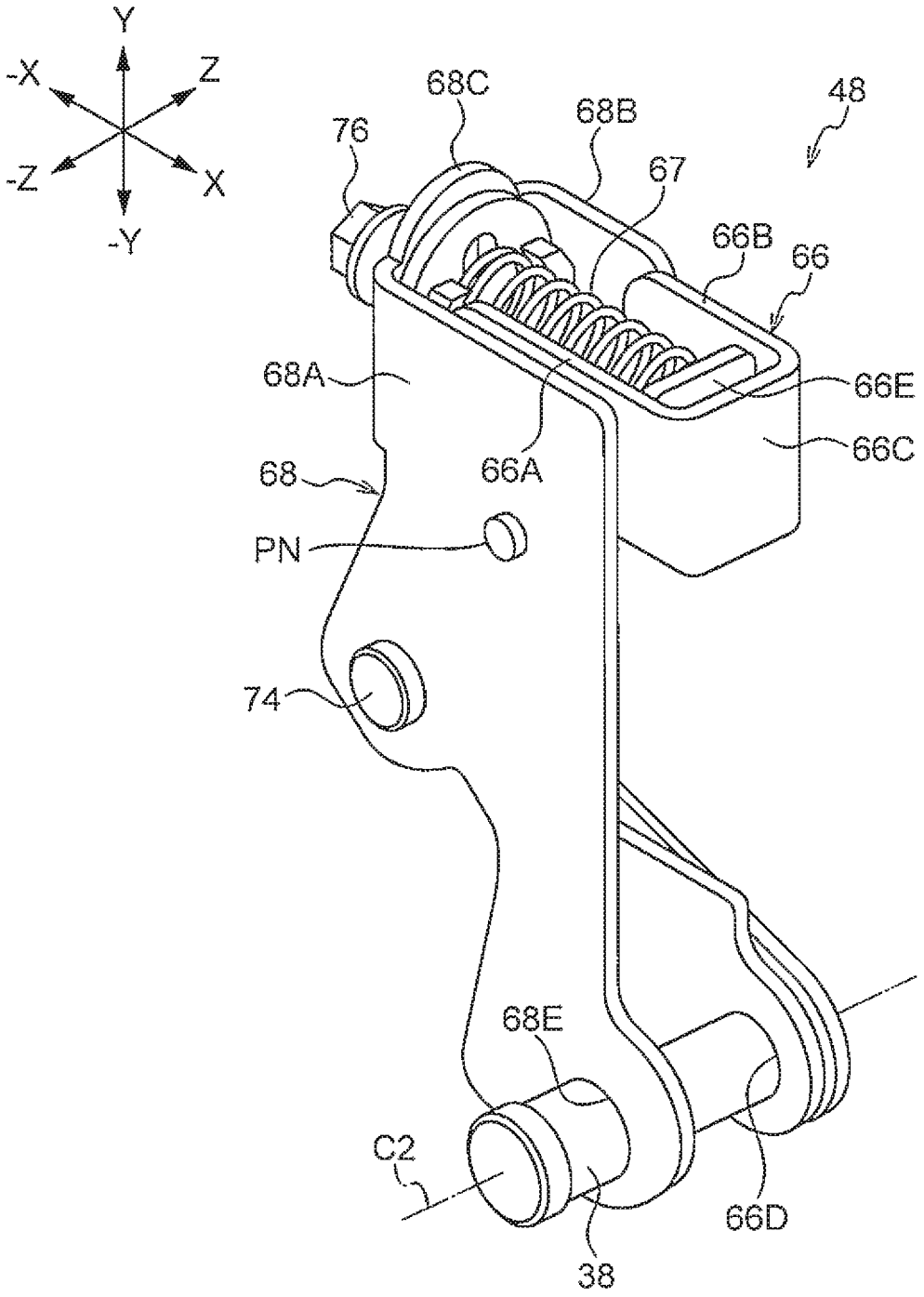
FIG. 3 is a perspective view of a first lever member and a second lever member constituting the fixing device according to the first exemplary embodiment.

As shown in FIGS. 2 and 3, the pressure member 48 includes the pressure pad 62, a holder 64 that holds the pressure pad 62, first lever members 66 that support the holder 64, and second lever members 68 to which the first lever members 66 are mounted in a movable manner. Furthermore, as viewed in the Z direction, the pressure member 48 can be moved in an arc about the axis C2 by the cam unit 80.

Pressure Pad

Figure 5A:
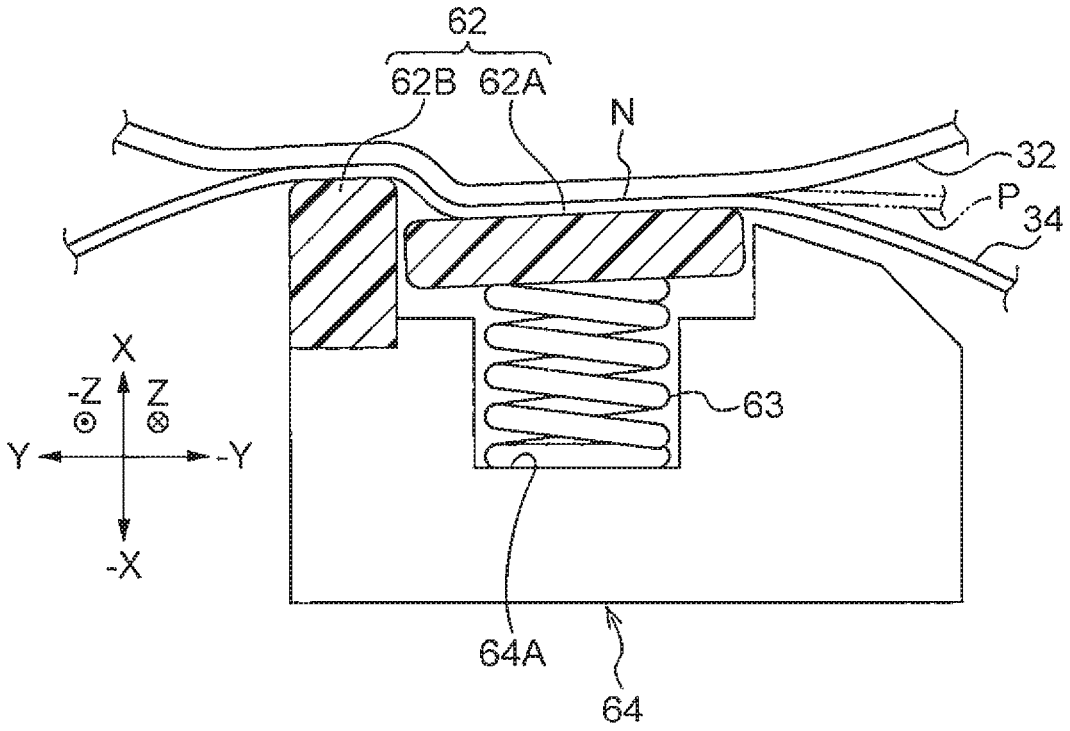
FIG. 5A shows a contact state between a fixing roller and a pressure belt in the fixing device according to the first exemplary embodiment, in the case where the pressure state of the nip is a full-latch state.
Figure 5B:
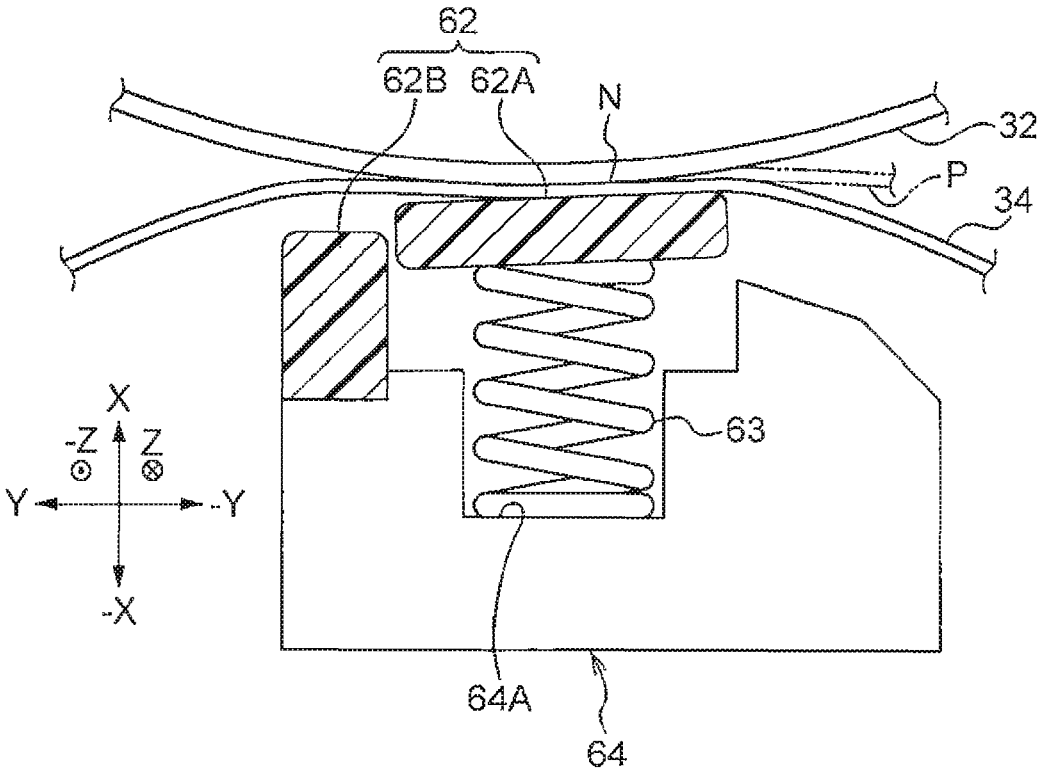
FIG. 5B shows the contact state between the fixing roller and the pressure belt in the fixing device according to the first exemplary embodiment, in the case where the pressure state of the nip is a half-latch state.

As shown in FIGS. 5A and 5B, the pressure pad 62 is disposed inside the pressure belt 34. The pressure pad 62 includes, for example, a pad member 62A and a pad member 62B.

The pad member 62A is formed of, for example, a rectangular-plate-shaped silicon rubber member having a longitudinal direction extending in the Z direction and a transverse direction extending in the sheet-transport direction. The pad member 62A is in contact with the pressure belt 34 over an area between the upstream end and a part before (upstream of) the downstream end of the nip N in the sheet-transport direction and applies pressure to the pressure belt 34 with an urging force exerted by a compression coil spring 63 (described below).

The pad member 62B is formed of, for example, a rectangular-parallelepiped-shaped silicon rubber member elongated in the Z direction. The pad member 62B is fixed to the holder 64 (described below) and is in contact with the pressure belt 34, at a downstream end part of the nip N in the sheet-transport direction, thus applying pressure to the pressure belt 34.

Holder

As shown in FIGS. 5A and 5B, the holder 64 is, for example, an elongated member elongated in the Z direction and is disposed inside the pressure belt 34. The holder 64 has a recess 64A recessed in the −X-direction, as viewed in the Z direction. The recess 64A accommodates the compression coil spring 63, which is deformed in the X direction. The compression coil spring 63 urges the pad member 62A against the pressure belt 34. The −X-direction end of the pad member 62B is fixed to the Y-direction end of the holder 64 with a screw (not shown). In addition, the Z-direction-ends of the holder 64 are fixed to the first lever members 66 (see FIG. 3) with screws (not shown).

Herein, as shown in FIGS. 2 and 5A, a pressure state in which the pad member 62A is pressed further toward the holder 64 than the pad member 62B (a state in which the pad member 62A and the pad member 62B are in contact with the pressure belt 34) is referred to as a full-latch state. Furthermore, as shown in FIGS. 4A and 5B, a pressure state in which the pad member 62A is in contact with the pressure belt 34 and in which the pad member 62B is not in contact with the pressure belt 34 is referred to as a half-latch state. In other words, when the fixing roller 32 and the pressure belt 34 are in contact with each other or nip a sheet P therebetween, a state in which the pressure belt 34 applies a higher pressure is the full-latch state, and a state in which the pressure belt 34 applies a lower pressure than that in the full-latch state is the half-latch state. As shown in FIG. 4B, a state in which the pressure applied by the pressure belt 34 is lower than that in the half-latch state (i.e., a non-contact state, in which the nip N is not formed) is referred to as an unlatched state.

FIG. 3 shows the first lever member 66 and the second lever member 68 on the −Z-direction side. The first lever member 66 and the second lever member 68 on the Z-direction side have the same configuration as those on the −Z-direction side, and the first lever members 66, as well as the second lever members 68, are disposed symmetrically with respect to the middle part of the holder 64 (see FIG. 2) in the Z direction. Hence, only the first lever member 66 and the second lever member 68 on the −Z-direction side will be described, and the description of the first lever member 66 and the second lever member 68 on the Z-direction side will be omitted. The Z-direction-ends of the holder 64 are fixed to U-shaped recessed portions in the first lever members 66 with screws (not shown).

First Lever Member

As shown in FIG. 3, the first lever member 66 includes an outer wall 66A and an inner wall 66B, which are disposed at a distance from each other in the Z direction, and a front wall 66C. The outer wall 66A is disposed on the −Z-direction side of the inner wall 66B. As viewed in the Z direction, the outer wall 66A and the inner wall 66B are formed in a U shape that opens toward the X-direction side. The front wall 66C connects the X-direction end, on the Y-direction side, of the outer wall 66A and the X-direction end, on the Y-direction side, of the inner wall 66B. Furthermore, a through-hole 66D extending in the Z direction is provided in the −Y-direction end of the outer wall 66A and the −Y-direction end of the inner wall 66B. The shaft 38 is inserted through the through-hole 66D. Thus, the first lever member 66 is mounted to the shaft 38 so as to be movable in an arc about the axis C2.

A plate-shaped press part 66E is provided in the first lever member 66, at a position on the −X-direction side of the front wall 66C. The press part 66E has a female screw part (not shown) penetrating in the X direction. The X-direction end of the compression coil spring 67 is in contact with the surface of the press part 66E facing the −X-direction side. The −X-direction end of the compression coil spring 67 is in contact with the second lever member 68 (described below). Hence, the Y-direction end of the first lever member 66 is urged in the direction away from the second lever member 68 by an urging force of the compression coil spring 67.

Second Lever Member

As shown in FIG. 3, the second lever member 68 includes an outer wall 68A and an inner wall 68B, which are disposed at a distance from each other in the Z direction, and a rear wall 68C. The outer wall 68A is disposed on the −Z-direction side of the inner wall 68B. The first lever member 66 is disposed between the outer wall 68A and the inner wall 68B.

As viewed in the Z direction, the outer wall 68A is formed in a U shape that opens toward the X-direction side. A shaft part 68D extending in the Z direction and projecting toward the −Z-direction side is provided at the X-direction end, on the Y-direction side, of the outer wall 68A. A cam follower 72, which has a cylindrical shape as viewed in the Z direction, is provided on the shaft part 68D so as to be rotatable about a shaft part 68D.

One end of a shaft 74 extending in the Z direction is attached to a middle part of the outer wall 68A, in the in the Y direction, on the −X-direction side. The other end of the shaft 74 is attached to a middle part of the inner wall 68B in the Y direction, on the −X-direction side. A cam follower 75 (see FIG. 2), which has a cylindrical shape as viewed in the Z direction, is provided on the shaft 74 so as to be rotatable about the shaft 74. Furthermore, a through-hole 68E extending in the Z direction is provided in the X-direction end, on the −Y-direction side, of the outer wall 68A. The shaft 38 is inserted into the through-hole 68E.

The inner wall 68B is formed in an L shape, as viewed in the Z direction. As described above, the other end of the shaft 74 in the Z direction is attached to a middle part of the inner wall 68B, in the Y direction, on the −X-direction side. A through-hole (not shown) extending in the Z direction is provided in the X-direction end, on the −Y-direction side, of the inner wall 68B. The shaft 38 is inserted into this through-hole. Specifically, the −Y-direction end of the outer wall 68A and the −Y-direction end of the inner wall 68B are coupled to each other so as to be rotatable about the axis C2 of the shaft 38. In other words, the second lever member 68 is provided on the shaft 38 so as to be movable in an arc about the axis C2, on the Z- and −Z-direction sides of the first lever member 66.

The rear wall 68C connects the −X-direction end, on the Y-direction side, of the outer wall 68A and the −X-direction end, on the Y-direction side, of the inner wall 68B. Furthermore, the rear wall 68C has a through-hole (not shown) extending in the X direction. An adjustment screw 76 is inserted into this through-hole so as to extend toward the X-direction side.

The adjustment screw 76 is inserted through the compression coil spring 67, between the rear wall 68C and the press part 66E. A male screw part (not shown) at the end of the adjustment screw 76 is screwed into the female screw part formed in the press part 66E of the first lever member 66. With this configuration, when the adjustment screw 76 is screwed in further, the compression coil spring 67 is compressed, increasing the urging force applied to the first lever member 66.

When the brackets 42 and the pressure member 48 are viewed in the Z direction, as shown in FIG. 2, when the pressure member 48 is moved clockwise about the axis C2, the brackets 42 are moved counterclockwise about the axis C1. Furthermore, when the pressure member 48 is moved counterclockwise about the axis C2, the brackets 42 are moved clockwise about the axis C1.

Cam Unit

As shown in FIG. 2, a cam unit 80 includes a shaft 81 rotated by a motor (not shown), and a cam 82 attached to the shaft 81. The shaft 81 is disposed in the housing 31 so as to extend in the Z direction. The Z-direction-ends of the shaft 81 are rotatably supported by the side walls 33 and bearings (not shown). The shaft 81 is disposed on the −X-direction side of the second lever members 68, such that the cam 82 and the cam follower 75 are in contact with each other.

As viewed in the Z direction, the cam 82 has an elliptical shape having a large-diameter part (i.e., a part corresponding to the long axis) and a small-diameter part (i.e., a part corresponding to the short axis). A recessed portion 82A is formed in the large-diameter part. A part between the large-diameter part and the small-diameter part is referred to as a middle-diameter part. A part of the cam 82 on the opposite side from the recessed portion 82A is referred to as a projecting portion 82B. When the cam 82 is rotated, moving, via the cam follower 75, the first lever member 66 and the second lever member 68 (see FIG. 3) in an arc about the axis C2 of the shaft 38, the pressure pad 62 presses the pressure belt 34. In short, the pressure belt 34 is moved toward the fixing roller 32 by the pressure member 48 and the cam unit 80 and is urged against the fixing roller 32.

When the projecting portion 82B of the cam 82 is in contact with the cam follower 75, the fixing roller 32 and the pressure belt 34 are in the full-latch state (see FIG. 2). When the middle-diameter part of the cam 82 is in contact with the cam follower 75, the fixing roller 32 and the pressure belt 34 are in the half-latch state (see FIG. 4A). When the recessed portion 82A of the cam 82 is in contact with the cam follower 75, the fixing roller 32 and the pressure belt 34 are in the unlatched state (see FIG. 4B). The unlatched state, the half-latch state, and the full-latch state are switched as a result of the controller 20 (see FIG. 1) actuating the cam unit 80 according to the type of the sheet P.

For example, when a thick sheet, which has a greater thickness than a normal sheet, is used for an image forming operation, the cam unit 80 is driven and controlled such that the half-latch state is achieved. When a normal sheet or a thin sheet, which has a smaller thickness than the normal sheet, is used for an image forming operation, the cam unit 80 is driven and controlled such that the full-latch state is achieved. Furthermore, when the image forming apparatus 10 is in a stand-by state, or when a sheet P is jammed in the fixing device 30 (a so-called paper jam), the cam unit 80 is driven and controlled such that the unlatched state is achieved. The pressure member 48 moves according to the type of the sheet P in this manner.

Interposed Member

The interposed members 100 adjust the distance d, that is, the width of the gap G between the distal end portion 46B and the outer circumferential surface of the fixing roller 32. As shown in FIG. 2, the interposed members 100 are elongated rod-shaped members. The interposed members 100 are made of, for example, metal.

The interposed members 100 each have, at one end thereof in the longitudinal direction, a through-hole 102 extending in the Z direction. A pin PN, which is provided on the second lever member 68 of the pressure member 48, is fitted into the through-hole 102. The interposed members 100 are supported by the pressure member 48 so as to be rotatable about the pin PN. The interposed members 100 are supported by the pressure member 48 on the Z-direction side and on the −Z-direction side.

The thickness (the width in the Y direction) of each interposed member 100 is gradually changed from one end to the other end in the longitudinal direction. More specifically, the interposed member 100 includes multiple portions having different thicknesses, which are, in this order from one end of the interposed member 100 in the longitudinal direction: a first portion 100A; a first inclined portion 100B; a second portion 100C; a second inclined portion 100D; and a third portion 100E. The first portion 100A, the second portion 100C, and the third portion 100E each have a constant thickness in the longitudinal direction of the interposed member 100, and their thicknesses increase in this order. The first inclined portion 100B and the second inclined portion 100D connect the longitudinally adjoining portions and are gradually increased in thicknesses from one end to the other end in the longitudinal direction. The heights (i.e., the lengths in the thickness direction of the interposed member 100) of the first inclined portion 100B and the second inclined portion 100D are smaller than the radius of the securing members 47. The first inclined portion 100B, the second portion 100C, the second inclined portion 100D, and the fourth portion 100E are formed on the other end side (the side opposite from the side provided with the through-hole 102) of the interposed member 100 in the longitudinal direction.

As has been described above, FIG. 2 shows the fixing device 30 in the full-latch state. In the full-latch state, the first portion 100A of the interposed member 100 is nipped between the fixing roller 32 (the core 32A) and the separating member 40 (the securing member 47), thus determining the distance d. FIG. 4A shows the fixing device 30 in the half-latch state. In the half-latch state, the second portion 100C of the interposed member 100 is nipped between the fixing roller 32 (the core 32A) and the separating member 40 (the securing member 47), thus determining the distance d. FIG. 4B shows the fixing device 30 in the unlatched state. In the unlatched state, the third portion 100E of the interposed member 100 is nipped between the fixing roller 32 (the core 32A) and the separating member 40 (the securing member 47), thus determining the distance d. The longitudinal direction of the interposed member 100 is an example of a direction intersecting the direction in which the interposed member 100 is nipped between the fixing roller 32 and the separating member 40.

As has been described above, the thicknesses of the first portion 100A, the second portion 100C, and the third portion 100E increase in this order, and the separating member 40 is rotatable about the axis C1. Hence, the interposed member 100 is configured to increase the distance d in the order of the full-latch state (see FIG. 2), the half-latch state (see FIG. 4A), and the unlatched state (see FIG. 4B).

With this configuration, the interposed members 100 serve to adjust the distance d according to the latch state, by being nipped between the fixing roller 32 and the separating member 40 at any of the portions having different thicknesses.

Thus, the description of the configuration of the relevant part according to this exemplary embodiment (the configuration of the fixing device 30) has been completed.

Fixing Operation

Next, the fixing operation with the fixing device 30 according to this exemplary embodiment will be described below with reference to the drawings. In the fixing operation in this exemplary embodiment, the controller 20 controls the fixing device 30 to heat, with the halogen heater 39, and rotate the fixing roller 32. However, in the fixing device 30 according to this exemplary embodiment, as has been described above, when a thick sheet, which has a greater thickness than the normal sheet, is used for an image forming operation, the cam unit 80 is driven and controlled such that the half-latch state is achieved, as shown in FIGS. 4A and 5B; when a normal sheet or a thin sheet, which has a smaller thickness than the normal sheet, is used for an image forming operation, the cam unit 80 is driven and controlled such that the full-latch state is achieved, as shown in FIGS. 2 and 5A; and when the image forming apparatus 10 is in a stand-by state, or when a paper jam occurs, the cam unit 80 is driven and controlled such that the unlatched state is achieved, as shown in FIG. 4B. The latch state is changed from one to another (the cam unit 80 is driven and controlled) by the controller 20 before the sheet P is transported by the transport section 12, as a result of, for example, an operator entering, via an input part (not shown), the type of the sheet P or the like used for the image forming operation, and the data about the type of the sheet P or the like being sent to the controller 20. The sheet P on which a toner image G is formed by the image forming section 14 and which is transported by the transport section 12 enters the nip N, where the toner image G is fixed, and is guided through the transport path A by the separating baffle 46. Thus, the fixing operation is completed.

Thus, the description of the fixing operation in this exemplary embodiment has been completed.

Advantage

Next, advantages (first, second, third, and fourth advantages) of this exemplary embodiment will be described below, by comparing this exemplary embodiment with comparison examples (first, second and third comparison examples). Note that, when components or the like mentioned in this exemplary embodiment will be mentioned in the comparison examples, the same reference signs and names will be used even when such components are not illustrated.

First Advantage

The first advantage is provided by a configuration in which the interposed member 100 is (rotatably) supported by the pressure member 48, includes, in the longitudinal direction, multiple portions having different thicknesses and is nipped between the fixing roller 32 and the separating member 40 at any one of these portions having different thicknesses, while moving in accordance with the rotation of the pressure member 48. The first advantage will be described by comparing this exemplary embodiment with a first comparison example (not shown).

The fixing device according to the first comparison example does not include the interposed members 100 and the securing members 47 (see FIG. 2). In the fixing device according to the first comparison example, the separating member 40 is positioned (in a non-rotatable manner) with respect to the side walls 33 (see FIG. 2). Other configurations of the first comparison example are the same as those of this exemplary embodiment.

Because of this configuration, in the first comparison example, the distance d (the width of the gap G between the distal end portion 46B and the outer circumferential surface of the fixing roller 32) is not adjusted in accordance with the movement of the pressure member 48.

In contrast, as shown in FIGS. 2, 4A, and 4B, in the fixing device 30 according to this exemplary embodiment, the interposed member 100 is (rotatably) supported by the pressure member 48. The interposed members 100 are nipped between the fixing roller 32 and the separating member 40 at any one of the portions having different thicknesses, while moving in accordance with the rotation of the pressure member 48.

Hence, in the fixing device 30 according to this exemplary embodiment, it is possible to adjust the width of the gap G (distance d) between the fixing roller 32 and the separating member 40, in accordance with the change in the nip state between the fixing roller 32 and the pressure belt 34. In other words, in the fixing device 30 according to this exemplary embodiment, it is possible to adjust the distance d in accordance with the change in the nip state according to the thickness of the sheet P, that is, in accordance with the change in the latch state according to the thickness of the sheet P. Hence, in the image forming apparatus 10 according to this exemplary embodiment, when a medium having a specific thickness is used, a guide fault in the fixing device 30 (a so-called paper jam at the separating baffle 46) is suppressed, compared with a configuration in which the width of the gap G (distance d) between the fixing roller 32 and the separating member 40 cannot be changed in accordance with the change in the nip pressure between the fixing roller 32 and the pressure belt 34.

Second Advantage

The second advantage is provided by a configuration in which the first inclined portion 100B and the second inclined portion 100D connect longitudinally adjoining portions and are gradually increased in thickness from one end to the other end in the longitudinal direction of the interposed members 100. The second advantage will be described by comparing this exemplary embodiment with a second comparison example (not shown).

Interposed members (not shown) in the second comparison example each do not have the first inclined portion 100B or the second inclined portion 100D. Hence, in the interposed members in the second comparison example, surfaces perpendicular to the longitudinal direction of the interposed members are formed at the boundary between the first portion 100A and the second portion 100C and the boundary between the second portion 100C and the third portion 100E. Other configurations of the second comparison example are the same as those of this exemplary embodiment. Note that, because the second comparison example has a configuration that provides the first advantage, the second comparison example falls within the technical scope of the present invention.

Because of this configuration, in the second comparison example, when the interposed members are moved in accordance with a change in the latch state, the securing members may be caught by such boundaries between the portions having different thicknesses.

In contrast, in this exemplary embodiment, as shown in FIGS. 2, 4A, and 4B, the first inclined portion 100B and the second inclined portion 100D connect longitudinally adjoining portions and are gradually increased in thickness from one end to the other end in the longitudinal direction of the interposed members 100.

Hence, in the fixing device 30 according to this exemplary embodiment, compared with a case where surfaces perpendicular to the longitudinal direction of the interposed members 100 are formed at the boundary between first portion 100A and the second portion 100C and the boundary between the second portion 100C and the third portion 100E, the securing members 47 are less likely to be caught by the boundaries (i.e., the distance d can be smoothly adjusted).

Third Advantage

The third advantage is provided by a configuration in which the securing members 47 are cylindrical, and the radius of the securing members 47 is larger than the heights of the first inclined portion 100B and the second inclined portion 100D, that is, the heights of steps in the interposed members 100. The third advantage will be described by comparing this exemplary embodiment with a third comparison example (not shown).

The radius of the securing members 47 in the third comparison example is smaller than the heights of the steps in the interposed members 100. Other configurations of the third comparison example are the same as those of this exemplary embodiment. Note that, because the third comparison example has a configuration that provides the first and second advantages, the third comparison example falls within the technical scope of the present invention.

Because of this configuration, in the third comparison example, when the interposed members are moved in accordance with a change in the latch state, the securing members may be caught by such boundaries (steps) between the portions having different thicknesses.

In contrast, in this exemplary embodiment, as shown in FIGS. 2, 4A, and 4B, the radius of the securing members 47 is larger than the heights of the first inclined portion 100B and the second inclined portion 100D, that is, the heights of the steps in the interposed members 100.

Hence, in the fixing device 30 according to this exemplary embodiment, compared with a case where the radius of the securing members 47 is smaller than the heights of the steps in the interposed members 100, the securing members 47 are less likely to be caught by the boundaries (i.e., the distance d can be smoothly adjusted).

Fourth Advantage

A fourth advantage is provided by a configuration in which the fixing roller 32 is in contact with the interposed members 100 at the outer circumferential surface 32A1 of the core 32A. The fourth advantage will be described by comparing this exemplary embodiment with a fourth comparison example (see FIG. 10).

Figure 10:
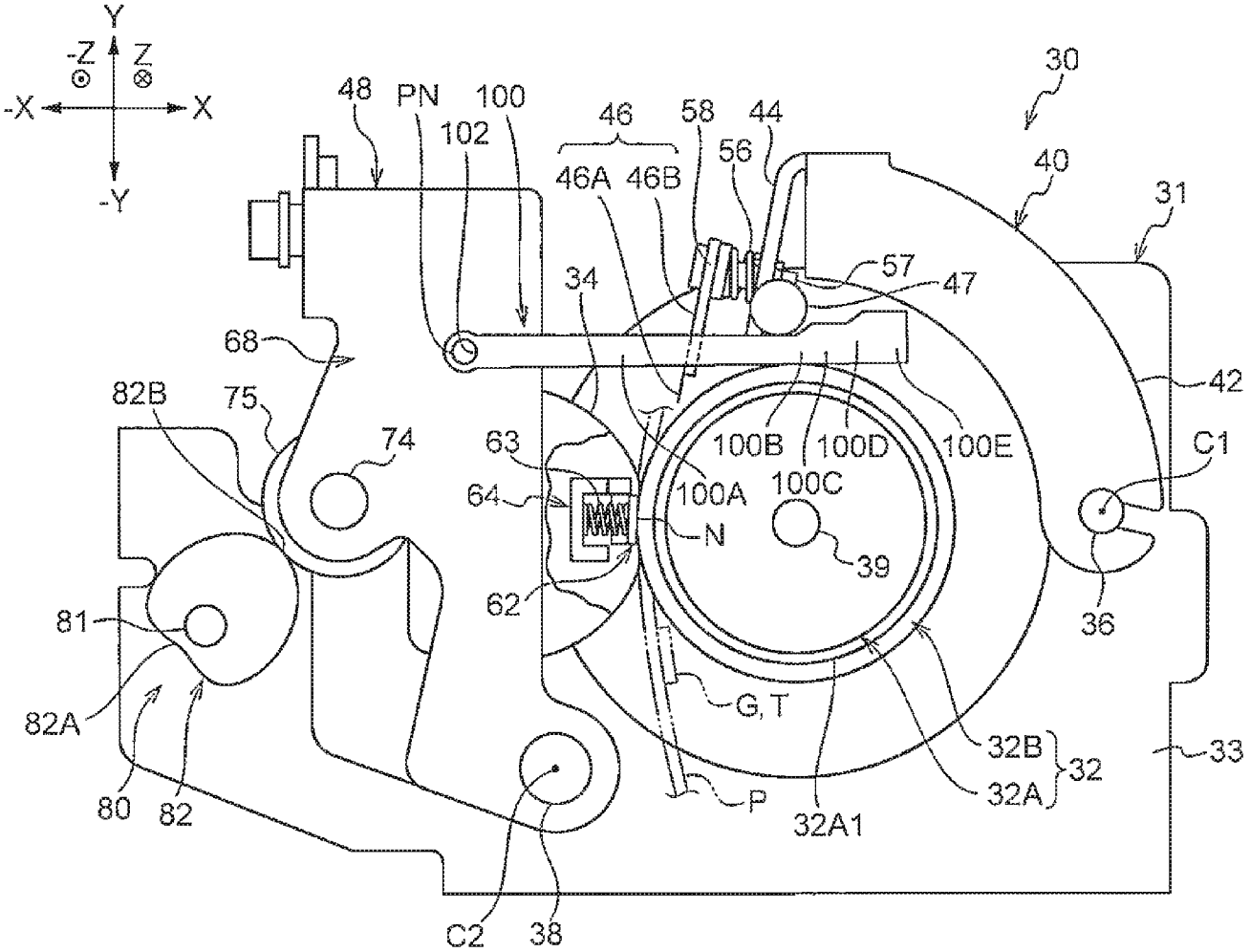
FIG. 10 is a front view of a fixing device constituting an image forming apparatus according to a fourth comparison example (another modification), showing the case where the pressure state of the nip is a full-latch state.

In the fourth comparison example, as shown in FIG. 10, the fixing roller 32 is in contact with the interposed members 100 at the outer circumferential surface of the rubber layer 32B (of the fixing roller 32). Other configurations of the fourth comparison example are the same as those of this exemplary embodiment. Note that, because the fourth comparison example has a configuration that provides the first, second, and third advantages, the fourth comparison example falls within the technical scope of the present invention.

In the fourth comparison example, because the interposed members 100 are in contact with the outer circumferential surface of the rubber layer 32B, the rubber layer 32B could be recessed, depending on the elastic modulus of the rubber layer 32B, or the like factors. Due to the long-term use, the degree by which the rubber layer 32B is recessed may change. As a result, the distance d changes in the fourth comparison example.

In contrast, in this exemplary embodiment, as shown in FIGS. 2, 4A, and 4B, the fixing roller 32 is in contact with the interposed members 100 at the outer circumferential surface 32A1 of the core 32A.

Hence, in the fixing device 30 according to this exemplary embodiment, compared with a configuration in which the fixing roller 32 is in contact with the interposed members 100 at the outer circumferential surface of the rubber layer 32B (of the fixing roller 32), the distance d is less likely to change.

Thus, the description of the advantages of this exemplary embodiment, as well as the description of the first exemplary embodiment, has been completed.

Second Exemplary Embodiment

Figure 7:
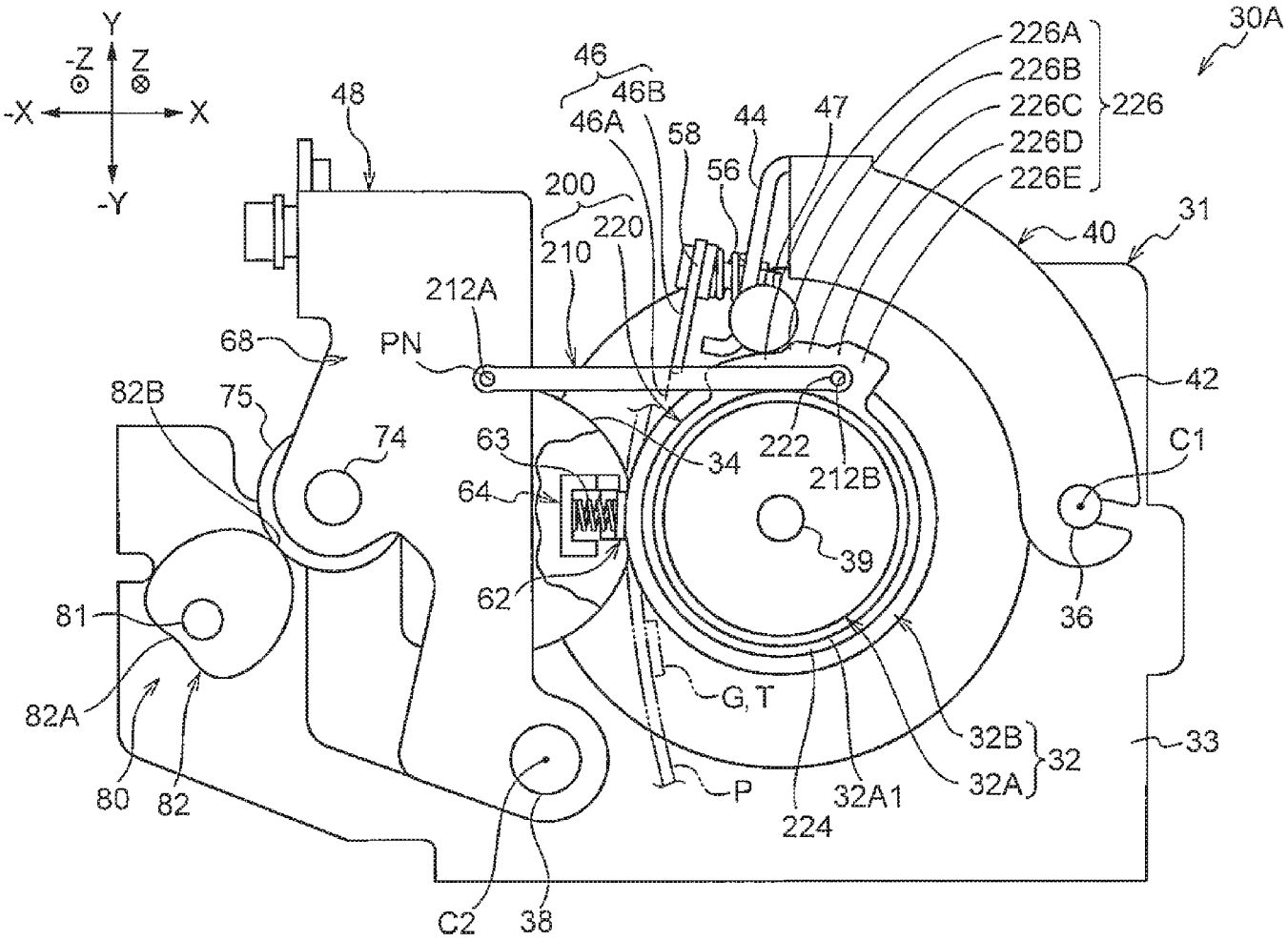
FIG. 7 is a front view of a fixing device constituting an image forming apparatus according to a second exemplary embodiment.

Next, a second exemplary embodiment will be described with reference to FIG. 7. Portions of this exemplary embodiment different from those of the first exemplary embodiment will be described below. Note that, when components or the like mentioned in the first exemplary embodiment will be mentioned in this exemplary embodiment, the same reference signs and names will be used even when such components are not illustrated.

Configuration

A fixing device 30A according to this exemplary embodiment (see FIG. 7) differs from the fixing device 30 according to the first exemplary embodiment (see FIG. 2) only in the configuration of interposed members 200. More specifically, the interposed members 200 according to this exemplary embodiment each include a support rod 210 and a rotation member 220. The fixing device 30A is an example of a transport device.

The support rod 200 is a rod having through-holes 212A and 212B at ends. The through-hole 212A provided at one end of the support rod 200 receives the pin PN provided on the second lever member 68 of the pressure member 48. Thus, the support rod 200 is supported by the second lever member 68 so as to be rotatable about the pin PN. The through-hole 212B provided at the other end of the support rod 200 receives a pin 222 provided on a rotation member 220 (described below).

The rotation member 220 is a ring-shaped member, and the core 32A of the fixing roller 32 is fitted to the inner circumference of the rotation member 220. Thus, the rotation member 220 is supported by the core 32A so as to be rotatable about the core 32A. The rotation member 220 includes the pin 222, a ring part 224, and a projecting portion 226.

The ring part 224 is a ring having, at the center thereof, a through-hole having an inside diameter equivalent to the outside diameter of the core 32A. The projecting portion 226 is formed on the outer circumference of the ring part 224 and projects in the radial direction of the ring part 224. The projecting portion 226 is formed over a predetermined area of the ring part 224 in the circumferential direction. The projecting portion 226 includes, for example, in this order in the clockwise direction as the fixing device 30A viewed from the Z-direction side: a first projecting portion 226A having a predetermined thickness; a first inclined portion 226B; a second projecting portion 226C having a larger thickness than the first projecting portion 226A; a second inclined portion 226D; and a third projecting portion 226E having a larger thickness than the second projecting portion 226C. The first inclined portion 226B and the second inclined portion 226D connect the portions adjoining each other in the circumferential direction of the ring part 224 and are gradually increased in thicknesses from one end to the other end in the circumferential direction. The rotation direction of (the ring part 224 of) the interposed member 200 is an example of a direction intersecting the direction in which the interposed member 200 is nipped between the fixing roller 32 and the separating member 40.

With this configuration, in the fixing device 30A according to this exemplary embodiment, the interposed members 200 is (rotatably) supported by the pressure member 48 and is nipped between the fixing roller 32 and the separating member 40 at one of the multiple portions having different thicknesses (any one of the first projecting portion 226A, the second projecting portion 226C, and the third projecting portion 226E) and at another portion (any one of the first projecting portion 226A, the second projecting portion 226C, and the third projecting portion 226E), in accordance with the rotation of the pressure member 48. FIG. 7 shows the fixing device 30A in a full-latch state.

Thus, the description of the configuration of this exemplary embodiment has been completed.

Fixing Operation

Next, the fixing operation with the fixing device 30A according to this exemplary embodiment will be described below, focusing on the difference to that of the first exemplary embodiment. In the fixing device 30A according to this exemplary embodiment, when a thick sheet, which has a greater thickness than the normal sheet is used for an image forming operation, the cam unit 80 is driven and controlled such that the half-latch state is achieved. At this time, the second projecting portion 226C of the interposed member 200 is nipped between the securing members 47 and the fixing roller 32. When a normal sheet or a thin sheet, which has a smaller thickness than the normal sheet, is used for an image forming operation, the cam unit 80 is driven and controlled such that the full-latch state is achieved, as shown in FIG. 7. At this time, the first projecting portion 226A of the interposed member 200 is nipped between the securing members 47 and the fixing roller 32 (not shown). Furthermore, when the image forming apparatus 10 is in a stand-by state, or when a paper jam occurs, the cam unit 80 is driven and controlled such that the unlatched state is achieved. At this time, the third projecting portion 226E of the interposed member 200 is nipped between the securing members 47 and the fixing roller 32 (not shown).

Thus, the description of the fixing operation in this exemplary embodiment has been completed.

Advantage

The advantages of this exemplary embodiment advantage are the same as those (the first, second, and third advantages) of the first exemplary embodiment.

Thus, the description of the advantages of this exemplary embodiment, as well as the description of the second exemplary embodiment, has been completed.

Although the present invention has been described by taking specific exemplary embodiments as examples, the present invention is not limited to the exemplary embodiments described above. For example, the following embodiments are also included in the technical scope of the present invention.

For example, in the above-described exemplary embodiments, it has been described that the separating baffle 46 is disposed at the distance d from the outer circumferential surface of the fixing roller 32. However, the fixing roller 32 and the pressure belt 34 may be exchanged, and the separating baffle 46 may be disposed at the distance d from the outer circumferential surface of the pressure belt 34. In this modification (not shown), the fixing roller 32 is an example of the second rotational member, and the pressure belt 34 is an example of the second rotational member.

Figure 8:
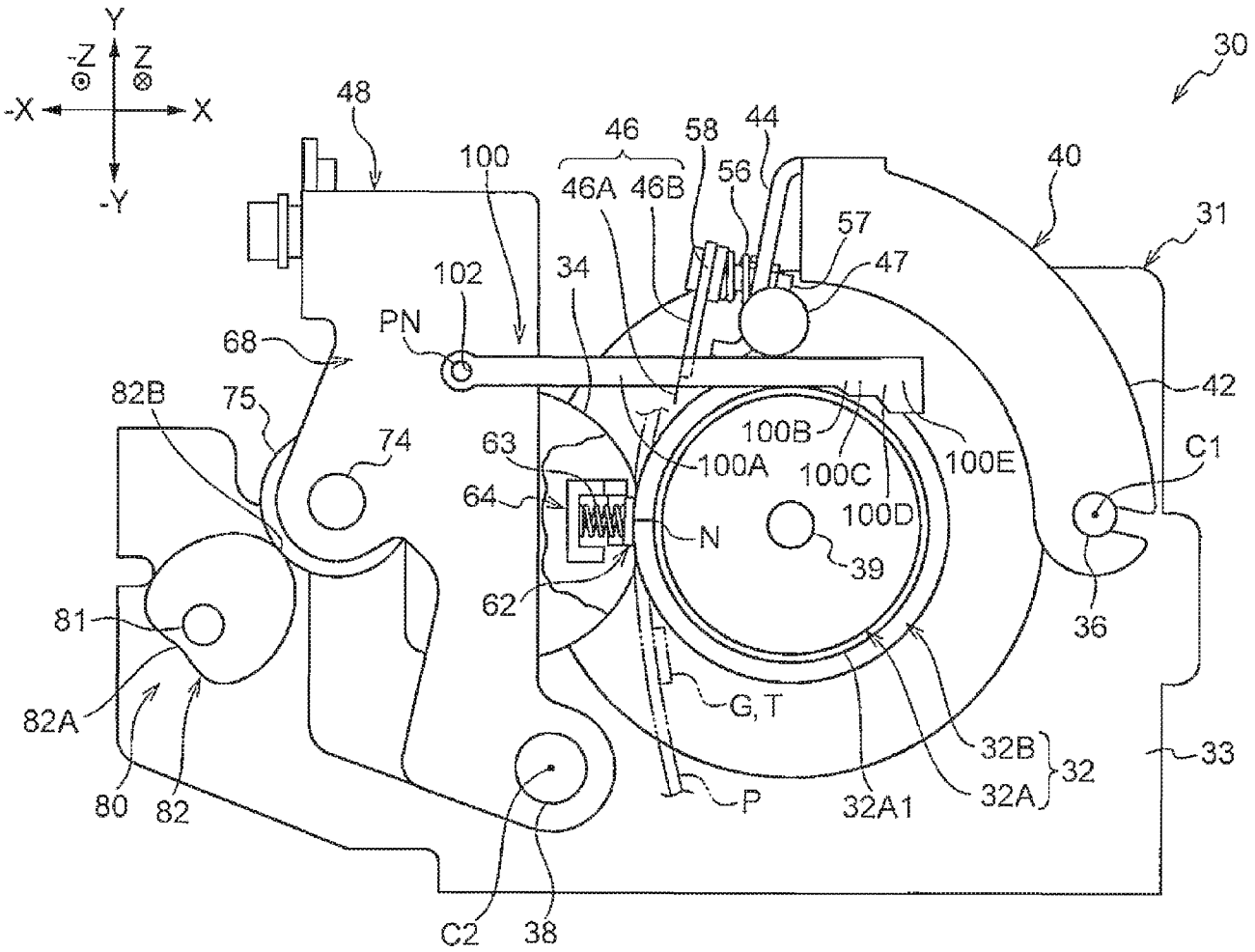
FIG. 8 is a front view of a fixing device constituting an image forming apparatus according to a modification.
Figure 9:
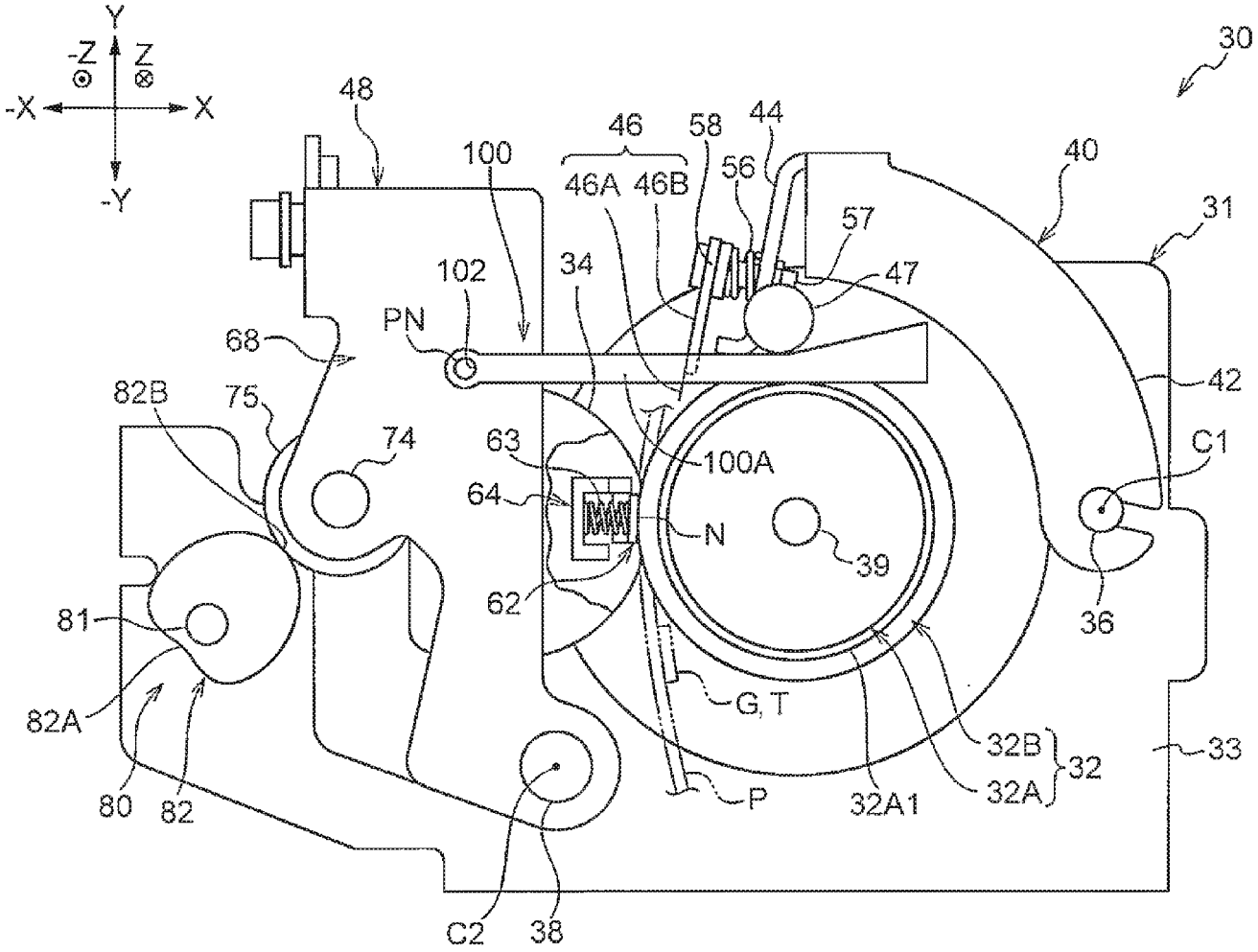
FIG. 9 is front view of a fixing device constituting an image forming apparatus according to another modification.

Furthermore, in the above-described exemplary embodiments, it has been described that the interposed members 100 and 200 are nipped, between the securing members 47 and the fixing roller 32 at any of the three portions having different thicknesses. Hence, in the above-described exemplary embodiments, it has been described that there are three latch states, namely, the full-latch state, the half-latch state, and the unlatched state. However, the configurations in which the interposed members 100 and 200 are nipped at any of the three portions having different thicknesses are merely examples, and the interposed members 100 and 200 may be nipped at two or four portions having different thicknesses. Furthermore, as shown in a modification illustrated in FIG. 8, the orientation of the interposed members 100 in the thickness direction may be reversed. Moreover, as shown in another modification illustrated in FIG. 9, the thickness of a portion of the interposed member 100 nipped between the securing member 47 and the fixing roller 32 may be gradually increased from one end to the other end. In this configuration, the portion to be nipped, which is gradually increased in thickness, may be regarded as being formed of multiple portions having different thicknesses.

In the above-described exemplary embodiments, the fixing devices 30 and 30A have been described as examples of a transport device. However, the transport device may be applied to a device other than the fixing device, as long as the device has a configuration in which an interposed member is (rotatably) supported by a pressure member, includes multiple portions having different thicknesses, and is nipped between a first rotational member and a separating member at any one of the portions having different thicknesses, in accordance with the rotation (movement) of the pressure member. Examples of the transport device include a decurler for decurling the sheet P and a dryer constituting an ink jet recording apparatus.

In the description of the fourth advantage of the first exemplary embodiment, it has been described that the first exemplary embodiment has an advantage over, for example, the fourth comparison example in that the distance d is less likely to be changed. However, the configuration as in the fourth comparison example, in which the fixing roller 32 is in contact with the interposed members 100 at the outer circumferential surface of the rubber layer 32B (see FIG. 2), is superior to the configuration as in the first exemplary embodiment, in which the fixing roller 32 is in contact with the interposed members 100 at the outer circumferential surface 32A1 of the core 32A (see FIG. 10), in the following point: because, when the rubber layer 32B is thermally expanded due to long-term use of the fixing device 30, the position of the guide member 40 needs to be adjusted, taking into consideration the amount expanded; the fourth comparison example, unlike the first exemplary embodiment, enables the position of the guide member 40 to be adjusted, by taking into consideration the amount expanded.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a first rotational member;

a second rotational member that forms a nip with the first rotational member and transports a medium by nipping the medium therebetween;

a guide member that is disposed so as to leave a gap with respect to the first rotational member and that comes into contact with the medium having passed through the nip to guide the medium in a predetermined direction;

a changing part that supports the second rotational member so as to be rotatable and that moves the second rotational member to change a nip state between the second rotational member and the first rotational member; and an interposed member supported by the changing part and nipped between the first rotational member and the guide member, the interposed member including, in an intersecting direction intersecting a direction in which the interposed member is nipped, a plurality of portions having different thicknesses, the interposed member being nipped at any one of the plurality of portions, while being moved in the intersecting direction in accordance with the movement of the second rotational member.

2. A fixing device comprising:

the transport device according to claim 1; and a heat source that heats one of the first rotational member and the second rotational member, wherein one of the transport device and the heat source is used as a heating part for heating a medium having a toner image formed thereon, and the other of the transport device and the heat source is used as a pressure part for applying pressure to the medium at the nip.

3. An image forming apparatus comprising:

the fixing device according to claim 2; and a forming section that forms a toner image on the medium.

* * * * *